US007551875B2

(12) United States Patent
Amarakoon

(10) Patent No.: US 7,551,875 B2
(45) Date of Patent: Jun. 23, 2009

(54) WIDE LATITUDE PRINTING SYSTEM

(75) Inventor: Kiri B. Amarakoon, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 919 days.

(21) Appl. No.: 10/993,851

(22) Filed: Nov. 19, 2004

(65) Prior Publication Data

US 2006/0110191 A1 May 25, 2006

(51) Int. Cl.
*G03G 15/00* (2006.01)

(52) U.S. Cl. ..... 399/110; 399/121; 399/307

(58) Field of Classification Search ..... 399/384, 399/307, 121, 407, 408, 409, 411, 113, 365, 399/383, 390, 396, 397
See application file for complete search history.

(56) References Cited

U.S. PATENT DOCUMENTS 4,134,341 A 1/1979 Weigele et al. ..... 101/142
5,629,775 A 5/1997 Platteter et al. ..... 358/296
5,875,383 A * 2/1999 Stemmle ..... 399/384
6,308,027 B1 * 10/2001 Obu et al. ..... 399/110
6,463,248 B1 * 10/2002 Jia et al. ..... 399/302
6,882,823 B2 * 4/2005 Matsuyama et al. ..... 399/401

* cited by examiner

*Primary Examiner*—David M Gray
(74) *Attorney, Agent, or Firm*—Ronald E. Prass, Jr.; Prass LLP

(57) ABSTRACT

A wide latitude printing system is provided for printing on a wide variety of different types, sizes, formats and weights of media substrates. The wide latitude printing system includes (a) at least one floor standing and movable marking engine assembly having an imaging member, devices for forming an image on the imaging member, (b) a floor standing and separately framed dockable and undockable transfix module for side by side docking with the marking engine assembly, the dockable and undockable intermediate transfix module including an intermediate transfer member for receiving the image from the marking engine assembly, and (c) a floor standing dockable and undockable media supply and handling module for side by side docking with the dockable and undockable transfix module, the dockable and undockable media supply and handling module including a set of different types of media substrates for receiving the image from the intermediate transfer member onto one of the set of different types of media substrates.

20 Claims, 5 Drawing Sheets

WIDE LATITUDE PRINTING SYSTEM

The present invention is directed to printing systems, and more particularly to a wide latitude printing system for selectively and effectively printing on a wide variety of different types, sizes, formats and weights of media substrates.

Printing systems such as direct marking solid ink printers and xerographic printers and copiers, increasingly are being called upon to be smaller and cheaper, and to provide faster yet more reliable and relatively higher quality images on a host of different types and varieties of media or substrates.

In current xerographic color and mono systems, for example, it has been found that media latitude, (that is the types and varieties of final image carrying substrates), is determined and limited by the image transfer and fusing capabilities that are built within the constraints of the system. Such constraints include footprint and cost constraints, and so a major short fall in such systems is the inability to handle a wide variety of substrate sizes, formats and weights. The ability to handle continuous roll feed media for example is normally compromised by built in cut sheet and roll fusing architectures.

Examples of prior attempts for handling different types of media or substrate in such systems are disclosed in the following references including U.S. Pat. No. 5,875,383 entitled "Dual mode interchangeable modules cut sheet or web printing system with a single xerographic cut sheet print engine" that discloses a plural mode printing system utilizing a cut sheet print engine for printing conventional cut sheet print substrates, in which page print images are generated and transferred to the cut sheets at an image transfer station. This plural mode printing system selectively provides printing onto either the cut sheets or onto an uncut continuous web printing substrate, in the same cut sheet print engine. An independently moveable continuous web printing substrate supply module is selectively operatively docked with the cut sheet print engine. That web printing module has a web feeding and image transfer assistance system for feeding the continuous web uncut into the cut sheet printing engine for transferring the page print images onto the web instead of onto cut sheets when the print engine is operatively docked with the web printing substrate module. The web printing module does not itself need to print. Rather, it can feed an extended loop of the continuous web into the cut sheet print engine image transfer station. The web module may provide either simplex printing or duplex printing onto both sides of the web with a duplexing system for feeding the web into the print engine for image transfer twice, with web inversion in between. The web modules are also preferably interchangeable with an optional cut sheet supply module.

U.S. Pat. No. 5,629,775 entitled "System architecture for attaching and controlling multiple feeding and finishing devices to a reproduction machine" discloses an electronic image processing apparatus having a marking machine, a source of copy sheets, a controller, and a plurality of resources wherein each of the resources includes an associated processor for storing data related to the operational timing of the associated resource. A bus interconnects the processors to the controller for directing the operation of the image processing apparatus to provide images on the copy sheets and the controller includes circuitry for interrogating each of the processors for the operational timing data and logic for responding to the operational timing data of each of the processors for dynamically configuring the controller to operate in accordance with the operational timing of the processors.

U.S. Pat. No. 4,134,341 entitled "Duplicating apparatus" discloses a duplicating arrangement which includes a copying machine for copying an original and an offset printing machine operatively connected to the copying machine for producing prints from a master copy. The copying machine and the offset printing machine are both constructed so as to be independently functional modules with an automatic control device being provided for controlling the operation of the copying machine and offset printing machines such that, depending upon the duplications to be made, the duplicating arrangement feeds a copy from the copying machine to either a depository or the offset printing machine, wherein the copy so-forwarded serves as a master copy in the offset printing machine.

In the description herein the terms "web", and "sheet or substrate", respectively refer to a flimsy physical elongate web, or cut substrate, of paper, plastic, or other suitable physical substrate for printing images thereon. The term "intermediate" is used in reference to image transfer members to describe the temporary transfer of the image to such member prior to subsequent transfer from such member to a substrate. The term "intermediate" is used in reference to the transfix module to describe the position of the transfix module as being between or intermediate the marking engine assembly and the media module.

SUMMARY

In accordance with an aspect of the present disclosure, there has been provided a wide latitude printing system for printing on a wide variety of different types, sizes, formats and weights of media substrates. The wide latitude printing system includes (a) at least one floor standing and movable marking engine assembly having an imaging member, devices for forming an image on the imaging member, (b) a floor standing and movable dockable and undockable transfix module for side by side docking with the marking engine assembly, the dockable and undockable transfix module including an intermediate transfer member for receiving the image from the marking engine assembly, and (c) a floor standing and movable dockable and undockable media supply and handling module for side by side docking with the dockable and undockable transfix module, the dockable and undockable media supply and handling module including a set of different types of media substrates for receiving the image from the intermediate transfer member onto one of the set of different types of media substrates.

In accordance with another aspect of the present disclosure, there has been provided a wide latitude printing system for printing on a wide variety of different types, sizes, formats and weights of media substrates. The wide latitude printing system includes (a) a floor standing and movable marking engine assembly including a movable imaging member, devices for forming an image on the imaging member and a first image transfer station, (b) a first floor standing and movable, selectively dockable and undockable media supply and handling module including a first set of different types of media substrates for side by side docking with the marking engine assembly to receive the image from the imaging member at the first image transfer station onto one of a first set of different types of media substrates, (c) a floor standing and movable selectively dockable and undockable intermediate transfix module, including an intermediate transfer member and a second image transfer station, for selectively side by side docking with the marking engine assembly to receive the image from the imaging member at the first image transfer station, and (d) at least a second floor standing and movable selectively dockable and undockable media supply and handling module including a second set of different types of media substrates for selectively side by side docking with the selectively dockable and undockable intermediate transfix module to receive the image from the selectively dockable and undockable intermediate module at the second transfer station onto one of the at least second set of different types of media substrates.

BRIEF DESCRIPTION OF THE DRAWINGS

In the detailed description below, reference will be made to the drawings in which.

DETAILED DESCRIPTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
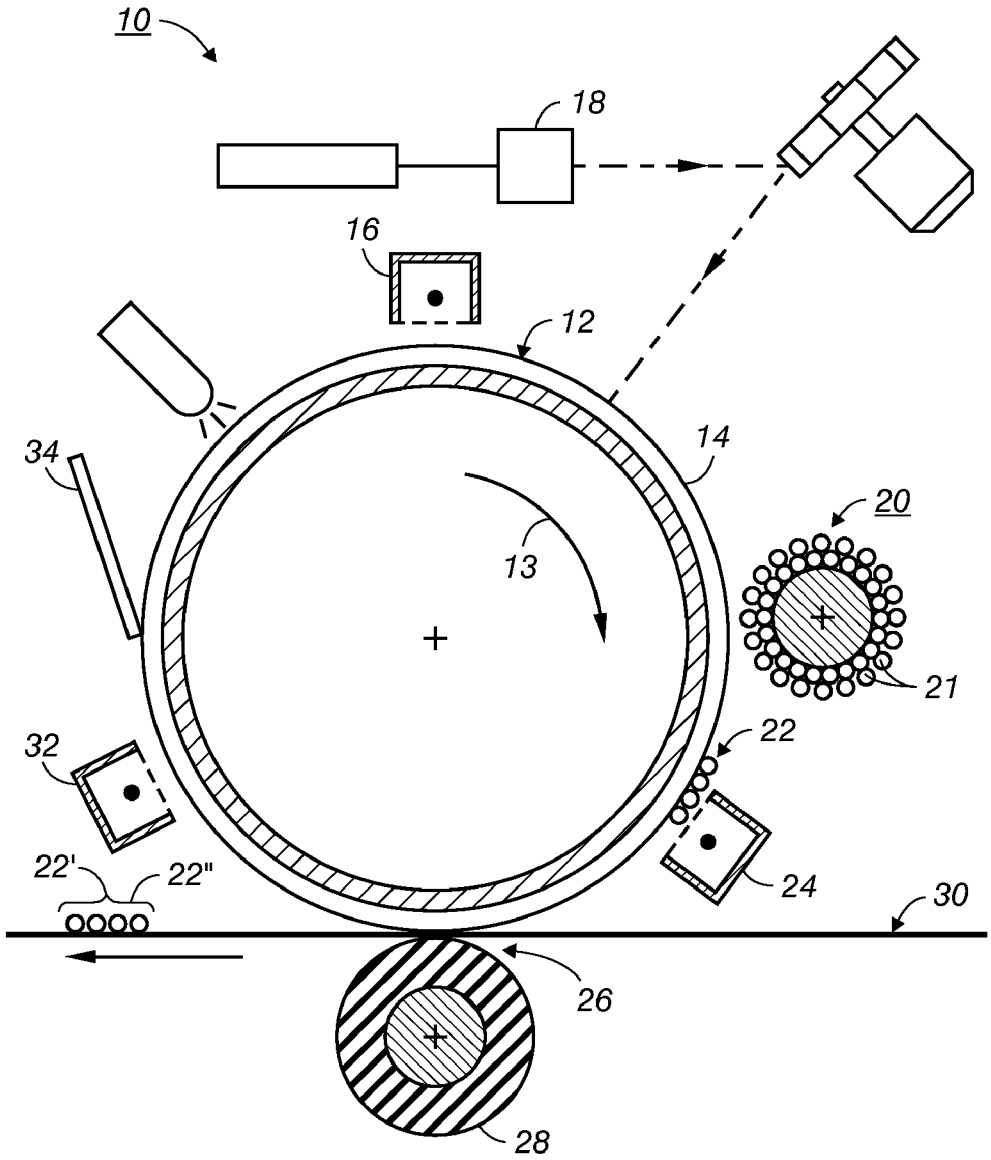
FIG. 1 PRIOR ART
FIG. 1 is a schematic of a prior art printer or marking engine assembly including a cut sheet supply apparatus.

Referring to FIG. 1, there is shown a schematic view of a xerographic printing unit or marking engine assembly 10 incorporating features of the present disclosure. As shown in FIG. 1, the xerographic printing unit or marking engine assembly 10 generally includes an endless imaging member or photoreceptor 12 shown here in the form of a drum, but as is well known in the art can equally be in the form of a belt. Imaging member 12 has a photoreceptive imaging surface 14 as shown and is moveable in the direction of arrow 13 past a series of xerographic imaging stations as will be described shortly. First a portion of the imaging surface 14 is moved past a first charging device 16 that uniformly charges such portion to a controlled and desired polarity. The charged portion is next moved past a latent image forming device such as a raster output scanner (ROS) system 18 that discharges areas of the charged portion leaving an image-wise charged pattern on such portion. As is well known, the ROS may equally create image-wise discharged areas leaving behind what will be image background areas.

The image-wise areas are next moved past a development apparatus 20, having marking materials such as toner particles 21, that develops or renders visible the latent image-wise areas forming a toner image 22 on the imaging surface 14. The toner image 22 may next be moved past a second charging device 24 for adjusting and/or controlling the charge then on the toner image 22. The toner image 22 is thereafter moved into a transfer nip 26 where it is transferred with the aid of a biased transfer roller 28 from the surface 14 onto a portion of an image receiving substrate 30 as toner image 22'. Toner image 22' as such may be a first and only image transferred onto such portion of the image receiving substrate 30, or it may be one of several, often differently colored, toner images transferred onto such portion, thereby forming a multi-color toner image 22" on such portion of the image receiving substrate 30. The image receiving substrate 30 may be a final image sheet as is well known, or it may be an intermediate transfer member or substrate such as an intermediate transfer belt member (as shown) from which the image 22', 22" is again then transferred onto a final image sheet.

After such transfer, the portion of the surface 14 from which the toner image 22', 22" was transferred is next moved through a third charging device 32 and then past a cleaning device 34 that cleans such portion in preparation for re-imaging by removing any residual toner particles left there after image transfer.

Figure 2:
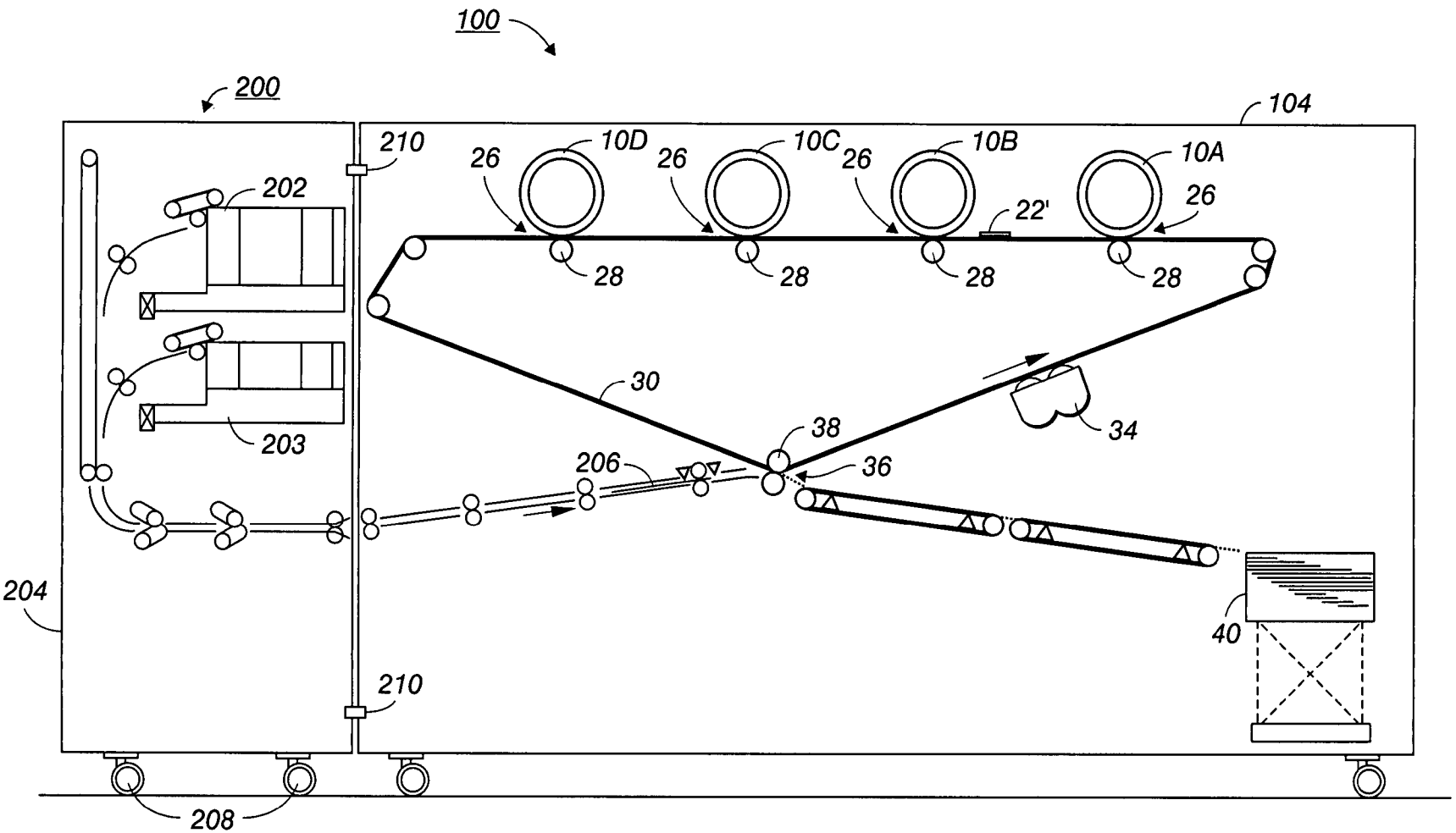
FIG. 2 PRIOR ART
FIG. 2 is a schematic of a prior art exemplary multicolor xerographic printing system including a directly dockable cut sheet supply module.

Referring now to FIG. 2, there is illustrated a floor standing and movable prior art exemplary multicolor xerographic system 100 having a frame 104 on casters as shown, and including a plural number (4) of printer units or marking engine assemblies shown as 10A, 10B, 10C and 10D. Each marking engine assembly 10A, 10B, 10C and 10D is configured and operates xerographically as the marking engine 10 as described above for producing a multicolored toner image 22" as also described above.

The multicolor xerographic system 100 also includes a cut sheet supply and handling module 200 that is floor standing and movable and has a frame 204 on casters 208, and is directly dockable side by side as shown by means 210 to the frame 104 of the system 100 for supplying cut sheet substrates 206 to the second transfer nip 36, to be final image carrying substrates. As illustrated, each of the printing units 10A, 10B, 10C and 10D produces a toner image 22 as described above, and transfers such toner image within a first transfer nip 26 at each printing unit onto the intermediate web substrate 30 to form a multicolor toner image 22". The multicolor toner image 22" is subsequently transferred within a second transfer nip 36 onto a final image carrying sheet 206 fed from supply sources 202, 203 of the dockable cut sheet module 200 as shown. The second transfer nip 36 may also include a heated fusing member 38 and thus doubles as a transfix nip for heating and fusing the transferred image 22" onto the substrate 206. The fused image carrying sheets are then moved from the transfix nip 36 to an output tray 40.

Unfortunately however, it has been found that in current xerographic color and mono systems such as the system 100 above, media latitude, (that is the types and varieties of final image carrying substrates), is determined and limited by the image transfer and fusing capabilities that are built within the constraints of the system 100 for example. Such constraints include footprint and cost constraints, and so a major short fall in such systems is the inability to handle a wide variety of substrate sizes, formats and weights. The ability to handle continuous roll feed media for example is normally compromised by built in cut sheet and roll fusing architectures.

Figure 3:
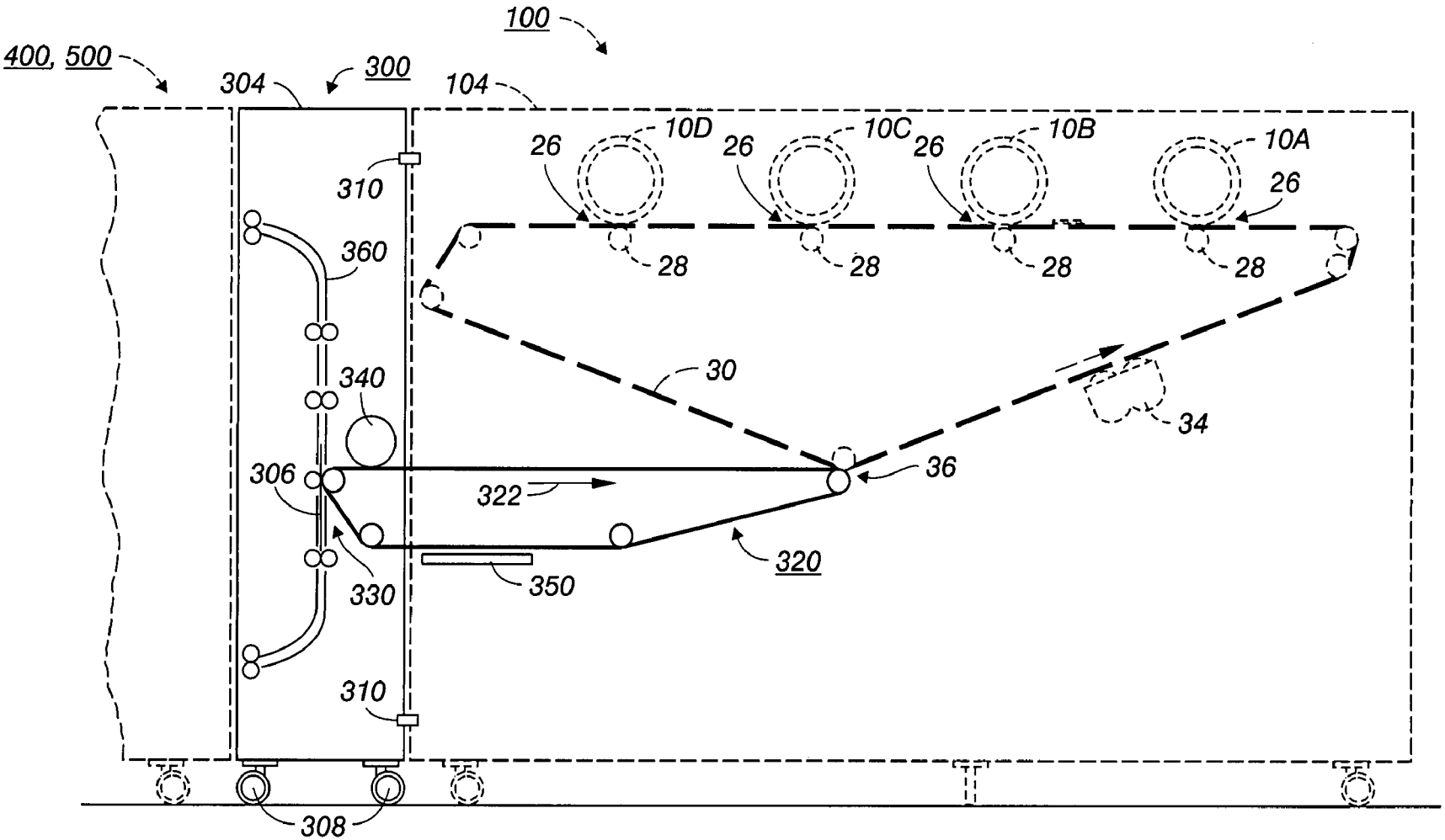
FIG. 3 is a schematic of the dockable intermediate transfix module in accordance with the present disclosure illustrated within an exemplary multicolor xerographic system shown in broken lines.

Referring now to FIG. 3, there is illustrated the dockable and undockable transfix module 300, of the present disclosure, that is suitable for enabling an overall printing system 600 (FIGS. 4 and 5 together) to print fast, high quality images on large variety of substrates despite the footprint and cost constraints of the marking engine assembly 100. In general as is well known in the art, a tranfix or tranfuse device is more than a mere fixing or fusing device because it includes an image receiving member onto which a toner image is simultaneously transferred and fixed or fused. The marking engine assembly 100 (FIGS. 1 and 2) includes at least a movable imaging member 12, marking materials 21, means (16, 18, 20) for forming an image 22 on the imaging member 12 using the marking materials, and additionally in one type of embodiment as shown, a first intermediate transfer member 30 for receiving the image 22. In embodiments where the marking engine assembly 100 does not include an intermediate member 30 for example black and white image modules, the transfix module 300 and the media supply modules 400, 500 (FIGS. 4 and 5 below) will be adapted to receive the image directly from the movable imaging member 12. Examples of such adaptation will have the top and bottom positions of the input station and output stations reversed, the positions of the heating means 350 and cleaning apparatus 340 reversed, and the direction 322 of movement of the intermediate member 320 reversed. This will allow the intermediate member 320 to be moving, within each transfer nip 26, 330, in the same direction as the imaging member 12 and the final copy substrate 406, 506.

Figure 4:
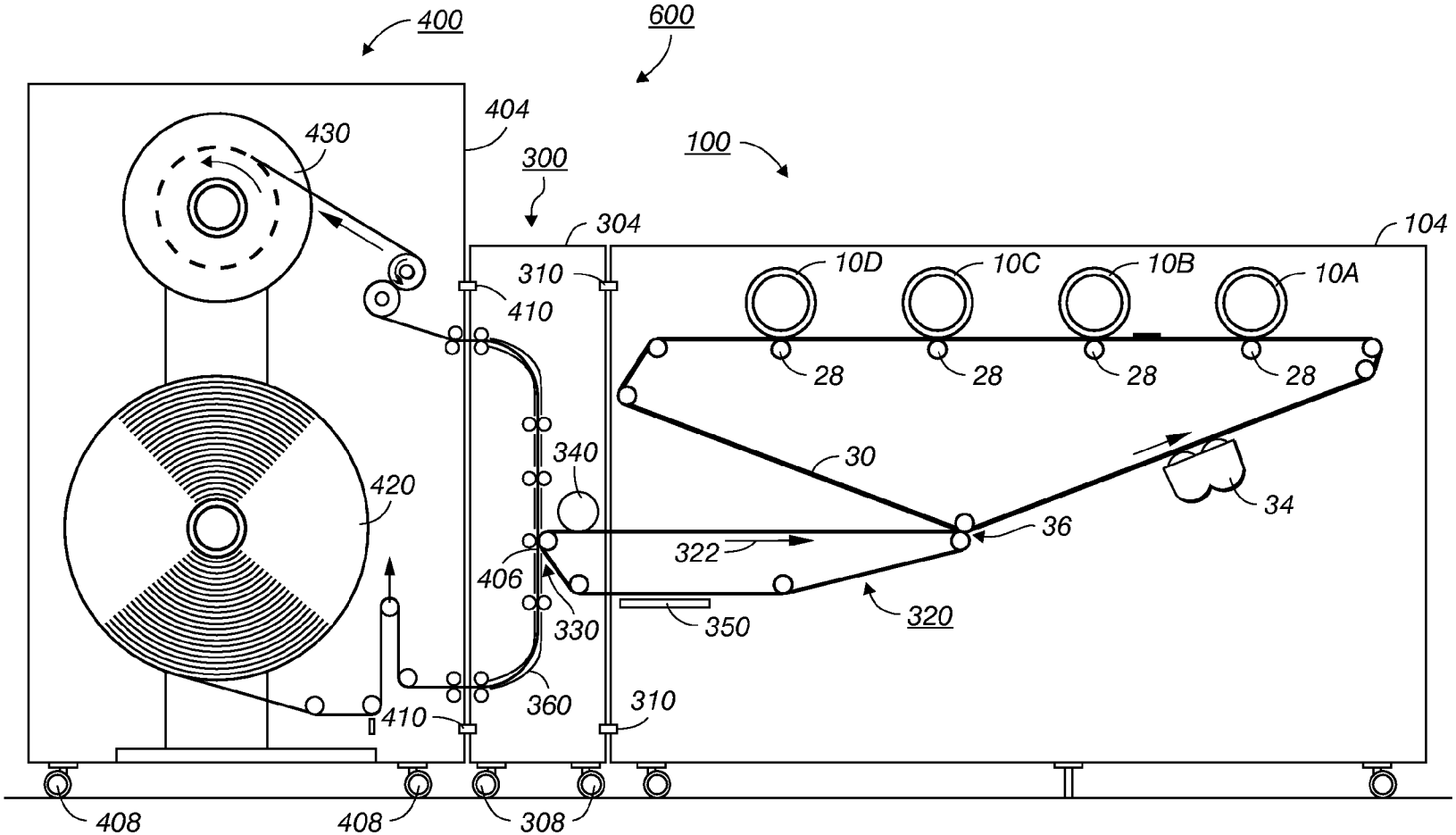
FIG. 4 is a schematic of a continuous web substrate embodiment of the exemplary multicolor xerographic system of FIG. 3 including the dockable intermediate transfix module in accordance with the present disclosure.
Figure 5:
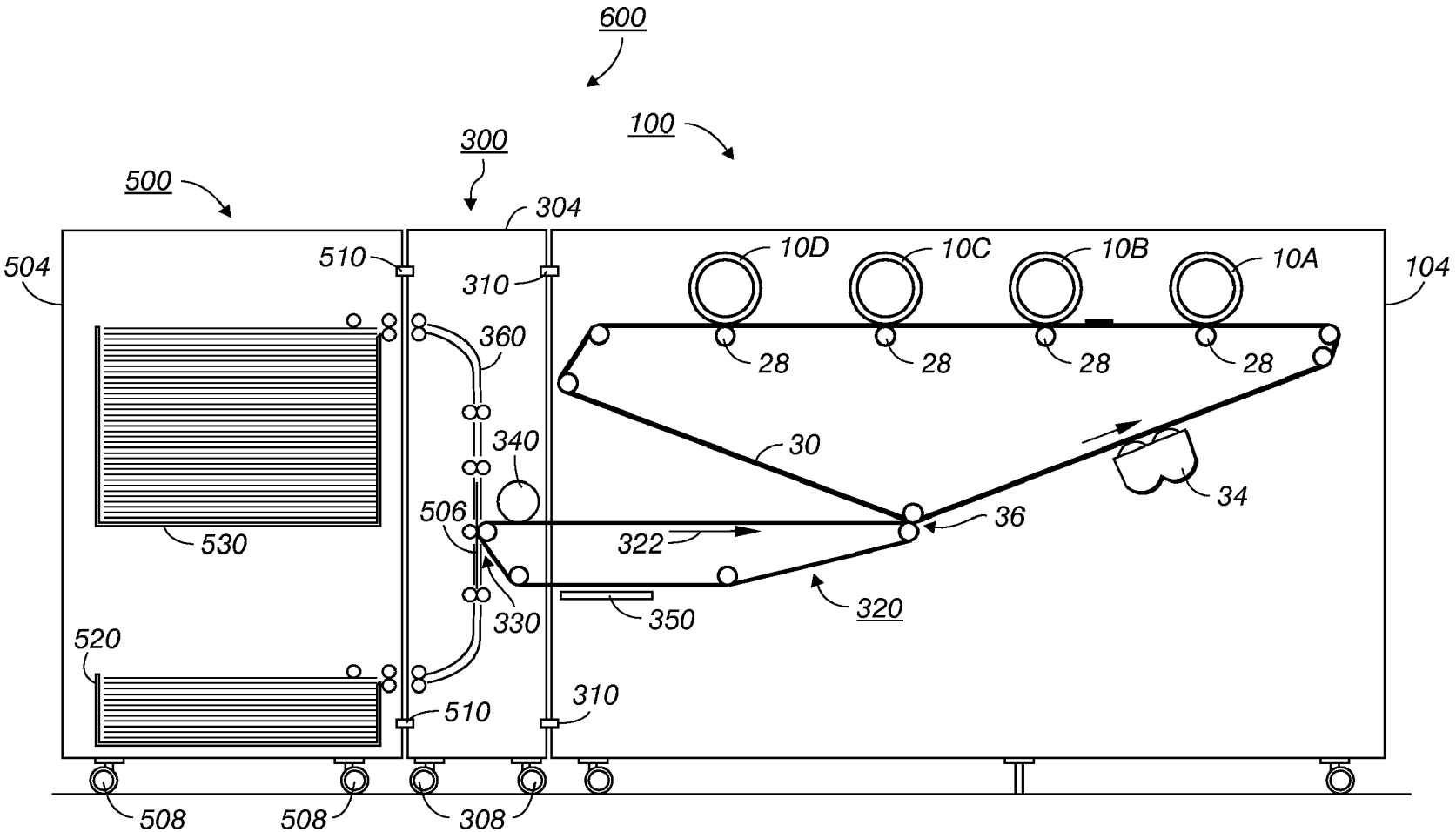
FIG. 5 is a schematic of a cut sheet embodiment of the exemplary multicolor xerographic system of FIG. 3 including the dockable intermediate transfix module in accordance with the present disclosure.

The overall system 600 contemplates running the system of FIG. 4, then as desired, selectively undocking the web media module 400 and in its place, side by side (as shown) docking the cut sheet media module 500 and then running it as the system of FIG. 5. In such a case, there could also be other media type supply and handling modules in addition to the continuous web and cut sheet modules 400, 500.

The dockable and undockable transfix module 300 as such offers a solution to these constraint problems because it is external to the marking engine assemblies system 100. Being external, the dockable and undockable transfix module 300 will bring the toned images 22" outside of the machine 100 to be transfixed either to a cut sheet feeder module 500 (FIG. 5) or to a roll feed module 400 (FIG. 4) as shown. This will enable transferring and fusing a wide variety of media including metallic, rough textured, plastic and other media that are not directly compatible with conventional xerographic transfer and fusing.

The dockable and undockable intermediate transfix module 300 as shown is floor standing and movable and includes a frame 304 on casters 308, first docking means 310 for docking with the marking engine assembly 100 that includes the belt 30 as a first intermediate transfer member. The dockable and undockable intermediate transfix module 300 also includes a second intermediate transfer member 320, moving in the direction of arrow 322, for receiving the image 22', 22" from the first intermediate transfer member 30 of the marking engine assembly 100 at a second transfer station or nip 36, and for bringing such toner image to a position external to the marking engine assembly 100, as shown. Thus, the dockable and undockable intermediate transfix module 300 includes two image transfer nips or stations, namely the second transfer station or nip 36 for transferring the image from the first intermediate transfer member 30 onto the second intermediate transfer member 320, and the third transfer station or nip 330 for transferring the image from the second intermediate transfer member 320 onto one 406, 506 of the sets of different types of media substrates, depending on which media module 400, 500 is docked side by side as shown with the transfix module 300.

A heating means such as an external heater 350 is provided along a path of movement of the second intermediate transfer member 320 for heating and fusing the image 22', 22" on the second intermediate transfer member 320 downstream (relative to arrow 322) of the second transfer nip 36 relative to as shown. The heated and fused image 22', 22" is subsequently transfixed from the second intermediate transfer member 320 to a desired final image substrate 306 at a third transfer nip 330. The second intermediate transfer member, belt 320 is made of thick conformable material having suitable conductivity. In order to bring the transferred image out of the machine 100, the belt 320 is made sufficiently long, and so each portion transferring an image within the third nip 330 will be sufficiently cooled by the time it comes into contact again with the first intermediate transfer member, belt 30 within the nip 36.

A cleaning device 340, such as a tacky brush or roller can be provided downstream (relative to arrow 322) of the third transfer nip 330 for cleaning the image carrying surface of the second intermediate transfer member 320.

The desired final image substrate 306 is fed to the third transfer nip 330 along a robust and adjustable media path 360 that is adaptable and suitable for handling a wide variety of media 306 including cut sheet, continuous web, that are metallic, rough textured, plastic, as well as other media that are conventionally will not directly be compatible with xerographic transfer and fusing for example. The path 30 may also include an inverter portion (not shown) for two-sided printing when using cut sheet media.

Referring now to FIGS. 4 and 5, the overall system 600 contemplates running the system of FIG. 4, then as desired, selectively undocking the web media module 400 (one of a plural number of such media modules) and in its place, side by side (as shown) docking the cut sheet media module 500 and then running it as the system of FIG. 5. In such a case, there could also be other media type supply and handling modules in addition to the continuous web and cut sheet modules 400, 500. For operating with the continuous web media module 400 (as a first selectable dockable and undockable media supply and handling module), the system 600 includes the floor standing and movable marking engine assembly 100, the floor standing and movable dockable and undockable intermediate transfix module 300 for side by side docking with the marking engine assembly 100, and the floor standing and movable selectively dockable and undockable continuous web media supply and handling module 400 itself.

The continuous web or first selectively dockable and undockable media supply and handling module 400 includes a frame 404 on casters 408, and means 410 for side by side docking with the dockable and undockable intermediate transfix module 300. In general the web media module 400 has input means 420 and a final image copy output station or means 430 that can be coupled to the path means 360 of the intermediate transfix module 300. As such, the web media module 400 is adapted to, and is capable of handling a first set 406 of different web types of media substrates for receiving the image from the second intermediate transfer member 320 when the web media module 400 as the first selectively dockable and undockable media supply and handling module is docked with the dockable and undockable intermediate transfix module 300.

As pointed out above, the overall system 600 may include a plural number (two or more) of dockable and undockable media modules such as 400, and 500. Thus referring to FIG. 5, there is illustrated at least a second selectively dockable and undockable media supply and handling module 500. For operating with the cut sheet media module 500 (as at least a second selectable dockable and undockable media supply and handling module), the system 600 includes the marking engine assembly 100, the dockable and undockable intermediate transfix module 300 for docking with the marking engine assembly 100, and he selectively dockable and undockable cut sheet media supply and handling module 500 itself.

The cut sheet or at least second selectively dockable and undockable media supply and handling module 500 includes a frame 504 on casters 508, and means 510 for docking with the dockable and undockable intermediate transfix module 300. In general the cut sheet media module 500 has input means 520 and a final image copy output station or means 530 that can be coupled to the path means 360 of the intermediate transfix module 300. As such, the cut sheet media module 500 is adapted to, and is capable of handling at least a second set 506 of different cut sheet types of media substrates for receiving the image from the second intermediate transfer member 320 when the cut sheet media module 500 as at least the second selectively dockable and undockable media supply and handling module is docked with the dockable and undockable intermediate transfix module 300.

As can be seen, there has been provided a wide latitude printing system for printing on a wide variety of different types, sizes, formats and weights of media substrates. The wide latitude printing system includes (a) at least one marking engine assembly having an imaging member, devices for forming an image on the imaging member, (b) a dockable and undockable transfix module for docking with the marking engine assembly, the dockable and undockable intermediate transfix module including an intermediate transfer member for receiving the image from the marking engine assembly, and (c) a dockable and undockable media supply and handling module for docking with the dockable and undockable transfix module, the dockable and undockable media supply and handling module including a set of different types of media substrates for receiving the image from the intermediate transfer member onto one of the set of different types of media substrates.

While the embodiments disclosed herein are preferred, it will be appreciated from this teaching that various alternatives, modifications, variations or improvements therein may be made by those skilled in the art, which are intended to be encompassed by the following claims.

What is claimed is:

1. A wide latitude printing system is provided for printing on a wide variety of different types, sizes, formats and weights of media substrates, the wide latitude printing system comprising:

(a) at least one floor standing marking engine assembly having an imaging member and devices for forming an image on said imaging member;

(b) a floor standing separately framed dockable and undockable intermediate transfix module for side by side docking with said marking engine assembly, said dockable and undockable intermediate transfix module including an intermediate transfer member for receiving said image from said marking engine assembly; and (c) a floor standing dockable and undockable media supply and handling module for side by side docking with said dockable and undockable intermediate transfix module, said dockable and undockable media supply and handling module including a set of different types of media substrates for receiving said image from said intermediate transfer member onto one of said set of different types of media substrates.

2. A wide latitude printing system for printing on a wide variety of different types, sizes, formats and weights of media substrates, the wide latitude printing system comprising:

(a) a floor standing marking engine assembly including a movable imaging member, marking materials, and means for forming an image on said imaging member using said marking materials;

(b) a floor standing dockable and undockable media supply and handling module including a set of different types of media substrates for receiving said image from said marking engine assembly onto one of said set of different types of media substrates; and (c) a floor standing and separately framed dockable and undockable intermediate transfix module for side by side docking between, and with, said marking engine assembly and said dockable and undockable media supply and handling module, said dockable and undockable intermediate transfix module including one intermediate transfer member for receiving said image from said marking engine assembly and then transferring said image to said one of said set of different types of media substrates.

3. The wide latitude printing system of claim 2, wherein said marking engine assembly includes another intermediate transfer member for receiving said image from said imaging member, and for transferring said image onto said one intermediate transfer member of said dockable and undockable intermediate transfix module.

4. The wide latitude printing system of claim 2, wherein said dockable and undockable intermediate transfix module includes heating means for heating and fixing said image.

5. The wide latitude printing system of claim 2, wherein said dockable and undockable intermediate transfix module includes a first transfer station for transferring said image from said marking engine assembly onto said one intermediate transfer member, and a second transfer station for transferring said image from said one intermediate transfer member onto said one of said set of different types of media substrate.

6. The wide latitude printing system of claim 2, wherein said dockable and undockable intermediate transfix module includes a cleaning apparatus for cleaning said one intermediate transfer member.

7. The wide latitude printing system of claim 2, wherein said one intermediate transfer member comprises a belt.

8. The wide latitude printing system of claim 2, wherein said set of different types of media substrates comprises cut substrates.

9. The wide latitude printing system of claim 2, wherein said dockable and undockable media supply and handling module include a continuous web substrate.

10. The wide latitude printing system of claim 4, wherein said heating means are positioned along a path of movement of said one intermediate transfer member for heating and fixing said image on said one intermediate transfer member.

11. The wide latitude printing system of claim 8, including a final image copy output station.

12. The wide latitude printing system of claim 9, including a final image copy output station.

13. A printing system comprising:

a) at least one floor standing marking engine assembly including an imaging member, means for forming an image on said imaging member, and a first intermediate transfer member for receiving said image from said imaging member;

b) a floor standing and separately framed dockable and undockable intermediate transfix module for side by side docking with said marking engine assembly, said selectively dockable and undockable intermediate transfix module including a second intermediate transfer member for receiving said image from said first intermediate transfer member; and (c) a floor standing dockable and undockable media supply and handling module for side by side docking with said dockable and undockable intermediate transfix module, said dockable and undockable media supply and handling module including a set of different types of media substrates for receiving said image from said second intermediate transfer member onto one of said set of different types of media substrates.

14. The printing system of claim 13, wherein said first intermediate transfer member comprises a belt.

15. The printing system of claim 13, wherein said dockable and undockable media supply and handling module includes a supply of different types of cut sheet substrates.

16. The printing system of claim 13, wherein said dockable and undockable media supply and handling module includes a supply of a continuous web substrates.

17. A wide latitude printing system for printing on a wide variety of different types, sizes, formats and weights of media substrates, the wide latitude printing system comprising:

(a) a floor standing marking engine assembly including a movable imaging member, marking materials, means for forming an image on said imaging member using said marking materials, and a first intermediate transfer member for receiving said image from said imaging member;

(b) a floor standing and separately framed dockable and undockable intermediate transfix module for docking with said marking engine assembly, said dockable and undockable intermediate transfix module including a second intermediate transfer member for receiving said image from said marking engine assembly;

(c) a first selectively floor standing dockable and undockable media supply and handling module for side by side docking with dockable and undockable intermediate transfix module, said first selectively dockable and undockable media supply and handling module including a first set of different types of media substrates for receiving said image from said second intermediate transfer member when said first selectively dockable and undockable media supply and handling module is docked with said dockable and undockable intermediate transfix module; and (d) at least a second selectively floor standing dockable and undockable media supply and handling module for side by side docking with said dockable and undockable intermediate transfix module, said at least second selectively dockable and undockable media supply and handling module including at least a second set of different types of media substrates for receiving said image from said second intermediate transfer member when said at least second selectively dockable and undockable media supply and handling module is docked with said dockable and undockable intermediate transfix module.

18. The system of claim 17, wherein said dockable and undockable intermediate transfix module includes heating means for heating and fixing said image.

19. The system of claim 17, wherein said dockable and undockable intermediate transfix module includes a first transfer station for transferring said image from said first intermediate transfer member onto said second intermediate transfer member, and a second transfer station for transferring said image from said second intermediate transfer member onto one of said set of different types of media substrates.

20. The system of claim 17, wherein said dockable and undockable intermediate transfix module includes a cleaning apparatus for cleaning said second intermediate transfer member.

* * * * *